United States Patent [19]

McGuire

[11] Patent Number: 4,496,519

[45] Date of Patent: Jan. 29, 1985

[54] NUCLEAR REACTOR VESSEL DECONTAMINATION SYSTEMS

[76] Inventor: Paul J. McGuire, 7402 E. Wethersfield Rd., Scottsdale, Ariz. 85260

[21] Appl. No.: 241,597

[22] Filed: Mar. 9, 1981

[51] Int. Cl.[3] ..... G21C 19/00; B05B 3/00; B08B 3/00

[52] U.S. Cl. ..... 376/316; 376/309; 376/260; 239/185; 134/168 R; 15/104.01 R

[58] Field of Search ..... 376/260, 308, 309, 310, 376/316, 249; 239/185, 186, 187, 227, 248, 263; 122/390, 391, 392; 134/148, 151, 144, 131, 167 R, 198, 168 R, 180, 181, 200; 211/113, 117, 115, 163, 166

[56] References Cited

U.S. PATENT DOCUMENTS

| | | | |
|---|---|---|---|
| 3,270,754 | 9/1966 | Moeller et al. . | |
| 3,487,841 | 1/1970 | Goodrum . | |
| 3,809,607 | 5/1974 | Murray et al. | 376/249 |
| 3,837,011 | 9/1974 | McTighe et al. | 134/168 R X |
| 3,878,857 | 4/1975 | Heibo | 239/227 X |
| 3,943,756 | 3/1976 | Aubert et al. | 376/249 X |
| 3,985,572 | 10/1976 | Petermann et al. . | |
| 4,112,535 | 9/1978 | Wild et al. . | |
| 4,163,455 | 8/1979 | Hebert et al. | 134/167 R |
| 4,174,999 | 11/1979 | Burns | 376/249 |
| 4,175,575 | 11/1979 | Cushing | 134/180 X |
| 4,219,976 | 9/1980 | Burack et al. | 134/181 X |
| 4,376,443 | 3/1983 | Mordy, Jr. | 134/168 R |

FOREIGN PATENT DOCUMENTS

| | | | |
|---|---|---|---|
| 2058766 | 5/1972 | Fed. Rep. of Germany | 376/309 |
| 0159599 | 12/1979 | Japan | 376/463 |

*Primary Examiner*—Richard E. Schafer
*Assistant Examiner*—Daniel Wasil
*Attorney, Agent, or Firm*—Maurice R. Boiteau

[57] ABSTRACT

There is disclosed in the present application, a decontamination system for reactor vessels. The system is operatable without entry by personnel into the contaminated vessel before the decontamination operation is carried out and comprises an assembly which is introduced into the vertical cylindrical vessel of the typical boiling water reactor through the open top. The assembly includes a circular track which is centered by guideways permanently installed in the reactor vessel and the track guides opposed pairs of nozzles through which water under very high pressure is directed at the wall for progressively cutting and sweeping a tenacious radioactive coating as the nozzles are driven around the track in close proximity to the vessel wall. The whole assembly is hoisted to a level above the top of the vessel by a crane, outboard slides on the assembly brought into engagement with the permanent guideways and the assembly progressively lowered in the vessel as the decontamination operation progresses. The assembly also includes a low pressure nozzle which forms a spray umbrella above the high pressure nozzles to contain radioactive particles dislodged during the decontamination.

7 Claims, 6 Drawing Figures

NUCLEAR REACTOR VESSEL DECONTAMINATION SYSTEMS

The present invention relates generally to improvements in cleaning apparatus and systems and more particularly to such apparatus and systems which are especially suited for performing decontamination operations in nuclear reactor vessels with minimal exposure of personnel to radiation.

Whenever a boiling water reactor vessel is to be entered either for a regular inspection, generally at least at eighteen month intervals, or for performing repair or maintenance, it is necessary that the interior of the vessel be decontaminated to prevent the exposure of personnel to excessive radiation doses or otherwise to limit the time during which persons may be exposed to the radiation. Typically, after a boiling water reactor has been on line for several months, the interior of its vessel becomes covered with a tenacious radioactive coating about 0.040 inch thick, rich in cobalt 60 and emitting radiation at the rate of approximately 5000 millirems per hour. Since the maximum permissible exposure of each worker during a period of thirteen consecutive weeks is limited to an accumulated exposure of 3000 millirems, it is seen that if the radiation level inside the vessel is not reduced before entry of personnel, each worker must remain inside the vessel for a very brief period and in any case would receive his maximum allowable dosage for a three month period in thirty six minutes. Heretofore, decontamination has been carried out by workers suspended inside the vessel, housed in a cubicle hanging down from a crane and manually directing high pressure water at the vessel wall. The workers must be used in brief relays and the operation is time consuming.

Because of severe requirements of the entire decontamination operation seen as a whole, no known apparatus has heretofore been entirely successful in achieving it. Among the requirements for an acceptable apparatus is the necessity of starting the operation with minimal exposure of personnel to radiation and that, once started, the operation proceed with little or no further exposure of personnel. Another requisite is the capability for removing the radioactive coating from the vessel wall with reliable uniformity at the same time that radioactive particles are contained against escape into the atmosphere. In addition, since the interior of reactor vessels usually contains obstructions, it is necessary that any apparatus for decontaminating the vessel not only operate in the presence of obstructions but also have the capability of removing contamination lodged around the obstructions.

In view of the foregoing, it is an object of the present invention to provide a system and apparatus meeting the requisites for decontaminating nuclear reactor vessels.

Another object is a decontamination apparatus which may be readily transported to the reactor site and, between uses, conveniently stored.

A more general object is to decontaminate nuclear reactor vessels without the need for entry into the vessel by personnel and the consequent exposure to massive radiation.

In the achievement of the foregoing objects, a feature of the invention relates to an apparatus comprising a circular track and two opposed pairs of nozzles for directing water under very high pressure toward the interior wall of a nuclear reactor vessel. The nozzles are rotatively driven while being guided by the track in close proximity to the wall, the radial forces acting on the connections to the two pairs of nozzles, being in opposite directions and thereby tending to keep the rotating nozzles centered on the track.

According to a related feature, each pair of nozzles used for the general purpose of removing a tenacious coating from the wall of the reactor vessel includes a first nozzle having a circular aperture for sharply focussing the high pressure water onto the wall to cut through the coating which is then swept away by a second nozzle mounted above the first and formed with an elongated slit aperture for directing a fan-shaped water pattern toward the wall.

A further feature relates to a nozzle mounted on the apparatus above the high pressure nozzles, supplied with low pressure water and formed with apertures for creating a spray umbrella above the high pressure nozzles to confine loosened radioactive particles to the interior of the vessel.

The foregoing objects, features and many advantages to be derived from the present invention will be more fully understood from the following detailed description of an illustrative embodiment taken in connection with the accompanying drawings in which.

Figure 1:
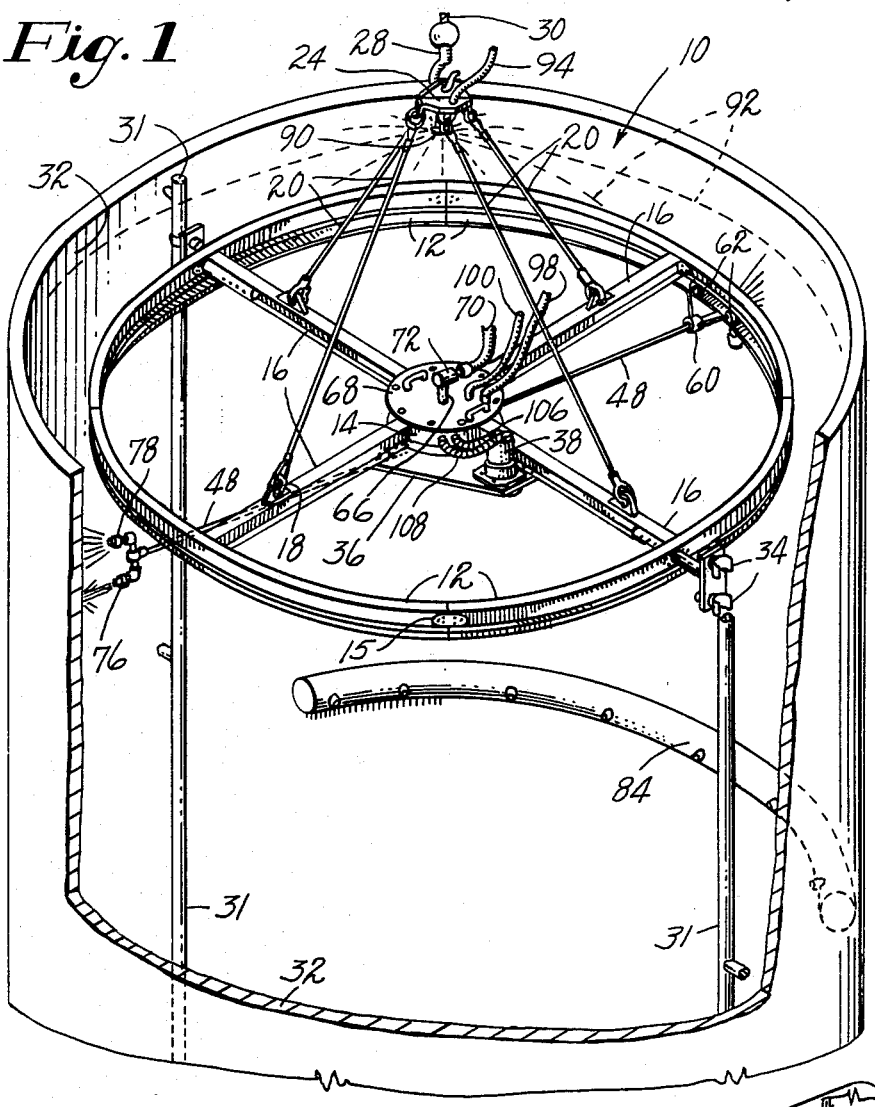
FIG. 1 is a view in perspective showing an apparatus according to the present invention at work on the interior wall of a nuclear reactor vessel which is shown partly broken away for clarity.
Figure 2:
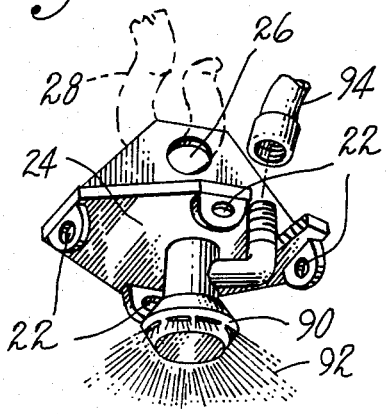
FIG. 2 is a fragmentary detail view in perspective showing a hanger plate by which the apparatus of FIG. 1 is suspended from a crane and also depicting a low pressure spray nozzle mounted on the plate and forming a part of the apparatus.
Figure 3:
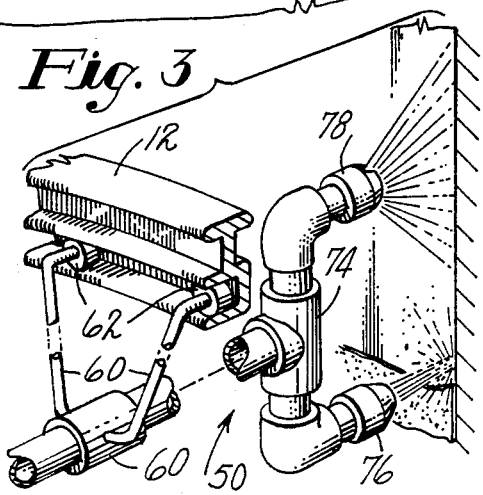
FIG. 3 is a fragmentary detail view in perspective depicting a pair of nozzles for operating on the interior wall of a nuclear reactor vessel.
Figure 5:
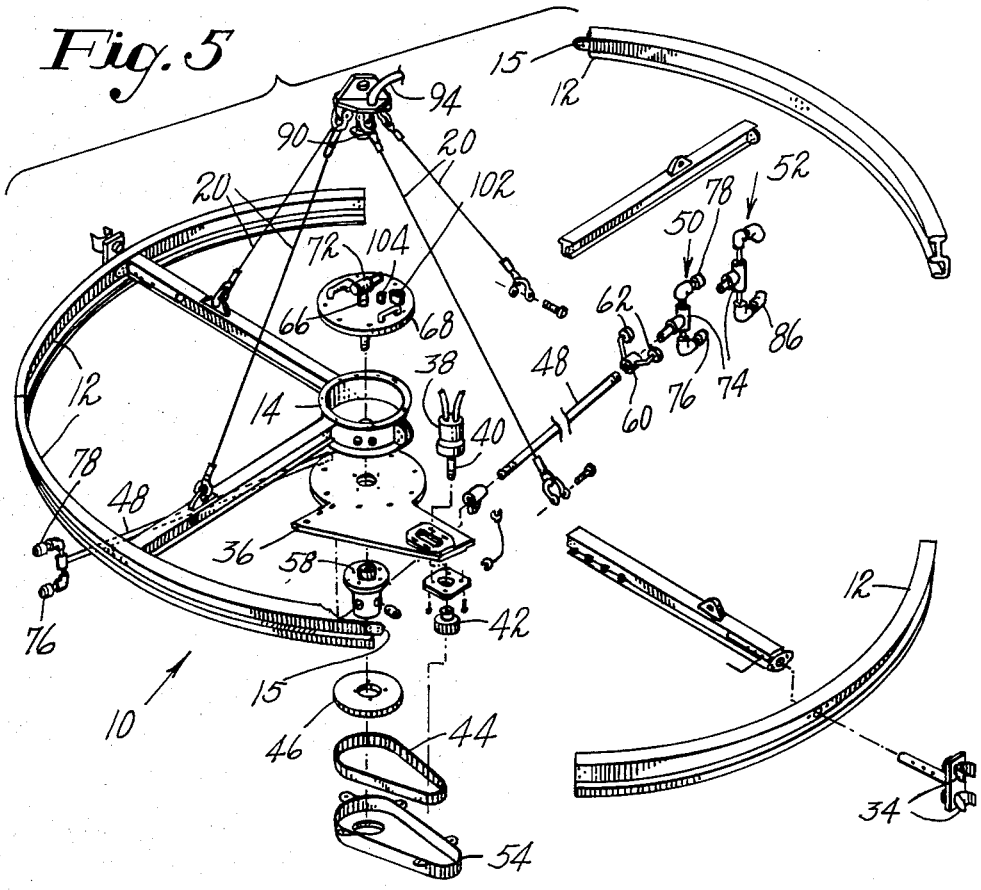
FIG. 5 is a view in perspective of the apparatus depicted in FIG. 1 with the parts shown in separated relationship for clarity.
Figure 4:
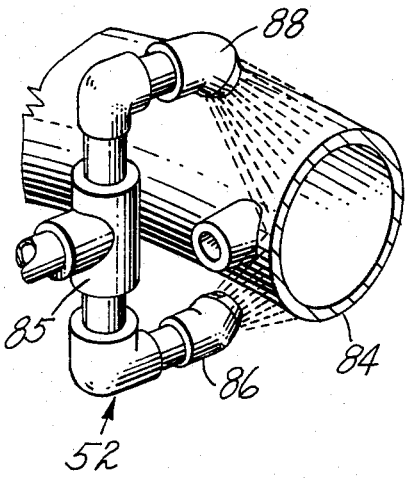
FIG. 4 is a view similar to FIG. 3 but depicting a pair of nozzles for decontaminating an area surrounding a feed water sparger which is typically mounted on the interior wall of the reactor vessel.

Turning now to the drawings, particularly FIGS. 1 and 5, there is shown an apparatus indicated generally at 10 and comprising a circular track 12 manufactured in four separate parts or sectors for ease of shipment and assembly at the reactor site and also to permit disassembly for ease of storage of the track, which is the largest unit of the entire assembly. Each of the track sectors 12 is interconnected to a ring-shaped hub 14 by an arm 16 fastened by screws at its ends to the related sector and hub and the sectors are connected together at their ends by bridging plates 15 and screws. At about the midpoint along the length of each of the arms 16 is an eye 18, connected by a cable 20 to a corresponding eye 22, best seen in FIG. 2, forming a part of a lifting plate 24. For raising the whole assembly and lowering it gradually into the reactor vessel, the lifting plate 24 is formed with a large eye 26 for receiving a hoisting hook 28 depending from the end of a cable 30 hanging from a crane for manipulating the assembly 10. A pair of rods 31 fixedly mounted in spaced relation with the inside wall of the reactor vessel 32 is engaged by two opposed pairs of spaced-apart followers 34 fixedly secured to the assembly 10 outside the track 12. The followers by their engagement with the rods 31 thus maintain the ring 12 centered in a generally horizontal plane. A mounting plate 36 is secured by bolts which join its edges to a pair of adjacent arms 16 and restrain the arms against pivotal movement at their connection points with the hub 14 and the track 12.

Figure 6:
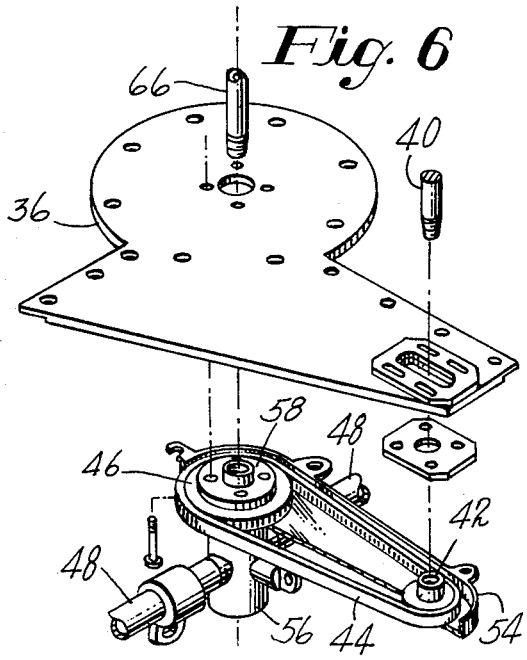
FIG. 6 is a view in perspective and on an enlarged scale of a central portion of the apparatus depicted in FIGS. 1 and 5 with the parts also shown in separated relationship for clarity.

The hub 14 is mounted on the plate 36 as is also an air-driven motor 38 whose shaft 40 extends down through the plate and carries secured to it, a timing pinion 42, best seen in FIG. 6. The pinion 42 is interconnected by a timing belt 44 to a driven timing wheel 46 for driving a pair of arms 48 which serve as conduits for and carry, each at its distal end, either a nozzle assembly indicated at 50 or alternatively one indicated at 52. The wheel 46 is mounted on a rotatable sleeve 56 forming part of a rotary connector with a flange 58 which is fixed by screws to the underside of the plate 36. The arms 48 are affixed to the lower portion of the sleeve 56 and are in communication with the interior of the sleeve. Each arm 48 carries, near its outer end, a bifurcated adapter 60 formed with two upwardly extending branches on the upper end of each of which is mounted a follower roll 62 engaging the track 12. The end portion of each of the arms 48 extends below and radially beyond the track 12 and has mounted on its distal end either a nozzle assembly 50 or a nozzle assembly 52, as will be seen hereinafter.

High pressure water at 10,000 psi is supplied to the nozzles 50 and/or 52 through connections including a pipe stub 66, which passes through a cover 68 secured to the upper end of the hub 14, through an aperture in the plate 36 and into threaded engagement with a tapped opening in the flange 58. The high pressure water is connected to the stub 66 through a flexible conduit 70 and a filter 72 in the shape of an elbow. The path of the water from the conduit 70 to the nozzle assemblies 50 or 52 includes the rotary connector 56, 58 which presents a relatively leak-free path between the rotating sleeve 56 and the stationary flange 58. As already indicated, the arms 48, which are high pressure pipes, are connected to the sleeve 56 which also carries the driven wheel 46 driven by the motor 38 so that the arms carrying the nozzle assemblies 50 or 52 are driven around the track 12. Each nozzle assembly 50 includes a tee-shaped fitting 74 and vertical extensions to lower and upper nozzles 76 and 78 respectively. Each lower nozzle 76 is formed to direct a narrow, generally cylindrical jet against the wall to cut the radioactive coating which is then swept away by a fan-shaped stream from each upper nozzle 78.

The nozzle assemblies 50 are used for removing the coating on the entire interior wall of the vessel except around a feed water sparger 84, where assemblies 52 are employed both for reaching around the sparger and also for decontaminating the area which would not be accessible with the assemblies 50. Each assembly 52 includes a tee-shaped fitting 85 and vertical extensions to upper and lower nozzles 86 and 88 respectively, both alike and designed each to direct a spray at approximately half of the sparger 84 as the nozzles are rotated around the track 12 without being downfed by the crane from which the assembly 10 is suspended. It will of course be understood that from the start of the decontamination operation to the level of the sparger 84, the whole assembly 10 is downfed by the crane from which it is suspended after the followers 34 have been engaged with the guide rods 31. As the sparger 84 is approached, the assembly is withdrawn from the vessel and the nozzle assemblies 52 substituted for the assemblies 50. For the purpose of replacement, the tee-shaped fittings 74 and 85 are internally threaded to receive the threaded ends of the arms 48. With the assemblies 52 in place, the assembly 10 is returned to the level of the sparger 84, being careful that the nozzles 86 and 88 are positioned above and below the sparger and the normal rotary motion is imparted to the arms 48 but without downfeeding, until the sparger area is cleaned. Then, the assembly is again withdrawn from the vessel and the nozzles 52 replaced by the nozzle 50. The assembly 10 is thereafter returned to the vessel to continue the normal decontamination operation, the assembly being gradually downfed by the crane until the bottom of the vessel is reached. Throughout the decontamination operation, low pressure water from a nozzle 90 on the underside of the lifting plate 24, forms a spray umbrella 92 above the nozzle assemblies 50, 52 for confining to the vessel any radioactive particles detached by the high pressure nozzles. The nozzle 90 is connected to a low pressure line 92. All the water from the interior of the of the vessel 32 is filtered and recirculated.

The rotary motion is imparted to the arms 48 by the air motor 38 which is supplied with compressed air through an inlet line 98 and exhausted through an outlet line 100 which carries the pressurized air from to motor to a release point outside the spray umbrella 92 to prevent the spreading of airborne radioctive particles in the atmosphere. The speed of the motor 38 is regulated by a control valve (not shown) in the inlet line 98. The inlet and outlet lines are connected respectively to inlet and outlet fittings 102 and 104. Interposed between the fittings 102 and 104 and the motor 38 are flexible inlet and outlet hoses 106 and 108 which pass through suitable openings in the hub 14.

From the foregoing description and the accompanying drawings, persons of ordinary skill will conceive of many alternative constructions within the scope of the invention. It is accordingly not intended that the present specification be taken in a limiting sense but rather that the scope of the invention be interpreted in terms of the appended claims.

Having thus disclosed my invention, what I claim as new and desire to secure by Letters Patent of the United States is:

1. A decontamination system adapted to being temporarily installed by being raised above and thereafter lowered progressively into an upright open-topped cylindrical nuclear reactor vessel during a decontamination operation being performed on the interior of the vessel, comprising guide means installed within the reactor vessel, a circular horizontal track smaller than the diameter of the vessel, means on the track for engaging the guide means to center the track in the vessel, a pair of oppositely directed arms supported and guided on the track, a high pressure nozzle assembly on each arm, each assembly including a pair of nozzles spaced apart from each other in a vertical direction, at least one of the nozzles being formed to direct a generally cylindrical jet toward the wall and at least one other nozzle being formed to direct a generally fan shaped sweeping pattern toward the wall, means for imparting a rotary motion to the arms in a full circle around the track with the nozzle assemblies in close proximity to the interior wall of the vessel and means for targeting fluid under high pressure through the nozzles at the interior wall.

2. A decontamination system according to claim 1 further comprising a low pressure nozzle means above the track for forming a spray umbrella over the high pressure nozzles for confining dislodged radioactive particles.

3. A decontamination system according to claim 1 further comprising a central hub, a plurality of radial arms interconnecting the track and the hub, hoisting means including a lifting plate above the track and means interconnecting the radial arms and the plate.

4. A decontamination system according to claim 3 further comprising a low pressure nozzle on the underside of the lifting plate for forming a spray umbrella over the high pressure nozzles for confining dislodged radioactive particles.

5. A decontamination system according to claim 1 further characterized in that the guide means comprises a pair of spaced apart vertical rods fixedly secured within the reactor vessel and centering means on the track for releasably engaging and continuing to engage the rods only while the decontamination operation is in progress to center the track in the vessel.

6. A decontamination system according to claim 1 further comprising means for driving the arms with their outer ends guided by the track and the nozzle assemblies in close proximity to the wall of the vessel.

7. A decontamination system according to claim 6 further characterized in that the means for driving the arms includes an air motor and means for regulating the supply of air to the motor to control its speed.

* * * * *